US008768214B2

(12) United States Patent
Lee et al.

(10) Patent No.: US 8,768,214 B2
(45) Date of Patent: Jul. 1, 2014

(54) IMAGE FORMING APPARATUS

(75) Inventors: Young Bok Lee, Seoul (KR); Tae Il Jung, Suwon-si (KR); Ki Hun Kim, Yongin-si (KR); Eun Ju Yun, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 188 days.

(21) Appl. No.: 13/315,493

(22) Filed: Dec. 9, 2011

(65) Prior Publication Data

US 2012/0148302 A1 Jun. 14, 2012

(30) Foreign Application Priority Data

Dec. 13, 2010 (KR) ..... 10-2010-0126855

(51) Int. Cl.
*G03G 15/08* (2006.01)
*G03G 15/16* (2006.01)

(52) U.S. Cl.
CPC ..... *G03G 15/161* (2013.01); *G03G 15/1605* (2013.01)
USPC ..... 399/121

(58) Field of Classification Search
CPC G03G 15/161; G03G 15/1605; G03G 21/168
USPC ..... 399/121, 124
See application file for complete search history.

(56) References Cited

U.S. PATENT DOCUMENTS

| | | | | |
|---|---|---|---|---|
| 2006/0083546 | A1* | 4/2006 | Lee | 399/124 |
| 2008/0006166 | A1* | 1/2008 | Ohkubo et al. | 101/479 |
| 2008/0240780 | A1 | 10/2008 | Yamauchi | |
| 2009/0022514 | A1* | 1/2009 | Fujiwara et al. | 399/121 |
| 2010/0003051 | A1* | 1/2010 | Sekina et al. | 399/121 |
| 2011/0091238 | A1* | 4/2011 | Nakazawa | 399/110 |
| 2011/0188885 | A1* | 8/2011 | Fukunaga | 399/110 |

OTHER PUBLICATIONS

European Search Report Issued on Apr. 3, 2012 in EP Patent Application No. 11192080.7.

* cited by examiner

*Primary Examiner* — Walter L Lindsay, Jr.
*Assistant Examiner* — Frederick Wenderoth
(74) *Attorney, Agent, or Firm* — Stanzione & Kim, LLP

(57) ABSTRACT

Disclosed is an image forming apparatus. The image forming apparatus includes a body frame, a support roller placed at one side of a movement path of a printing medium, a transfer roller assembly placed at the other side of the movement path of the printing medium at a position adjacent to the support roller, and a door to open or close the body frame so as to expose the movement path of the printing medium. The transfer roller assembly has a rotating axis kept at a fixed position of the body frame, and is moved away from the support roller in linkage with an opening operation of the door.

31 Claims, 11 Drawing Sheets

IMAGE FORMING APPARATUS

CROSS-REFERENCE TO RELATED APPLICATIONS

This application claims priority under 35 U.S.C. §119(a) from Korean Patent Application No. 2010-0126855, filed on Dec. 13, 2010 in the Korean Intellectual Property Office, the disclosure of which is incorporated herein by reference in its entirety.

BACKGROUND OF THE INVENTION

1. Field of the Invention

The present general inventive concept relates to an image forming apparatus having an improved configuration of a transfer roller assembly.

2. Description of the Related Art

An image forming apparatus includes a developing device to develop an electrostatic latent image, which has been formed on a photoconductor based on an image signal, using different colors of toners (e.g., yellow, magenta, cyan and black toners) to form a visible color image, and a transfer device to transfer the color image onto a printing medium for printing of the image.

The transfer device includes an intermediate transfer belt, a transfer roller, and a transfer roller separation/pressure device.

The transfer roller separation/pressure device allows the transfer roller to selectively come into contact with or be separated from the intermediate transfer belt. The transfer roller is spaced apart from the intermediate transfer belt while the toner image on the photoconductor is transferred to the intermediate transfer belt, whereas the transfer roller comes into contact with the intermediate transfer belt while the toner image on the intermediate transfer belt is transferred to a printing medium.

The transfer roller is installed to selectively come into close contact with a belt drive roller. The belt drive roller is supported by a rear cover and serves to drive the intermediate transfer belt. The transfer roller is separated from the intermediate transfer belt when the rear cover is opened, and comes into close contact with the intermediate transfer belt when the rear cover is closed. If the printing medium is jammed between the transfer roller and the intermediate transfer belt, the rear cover may be opened to enable easy removal of the printing medium.

SUMMARY OF THE INVENTION

The present general inventive concept provides an image forming apparatus, in which a transfer roller assembly has an improved configuration to minimize an assembly deviation thereof.

The present general inventive concept also provides an image forming apparatus, in which a transfer roller assembly has an improved configuration to enable easy removal of jammed paper.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus to form an image on a printing medium including a body frame, a support roller placed at one side of a movement path of the printing medium, a transfer roller assembly placed at another side of the movement path of the printing medium at a position adjacent to the support roller, and a door to open or close the body frame so as to expose the movement path of the printing medium, wherein the transfer roller assembly has a rotating axis kept at a fixed position of the body frame, and is moved away from the support roller in linkage with an opening operation of the door.

The transfer roller assembly may be returned toward the support roller in linkage with a closing operation of the door.

The transfer roller assembly may include a roller frame and a transfer roller rotatably supported on the roller frame, and the roller frame may be hinged to the body frame.

The transfer roller assembly may further include hinges provided at both sides of the roller frame and hinge receptacles formed in the body frame for insertion of the hinges.

The transfer roller assembly may further include a link member, one side of which is coupled to the roller frame and the other side of which is coupled to the door.

One side of the link member may be coupled to the roller frame so as to be rotated by a predetermined angle and the other side of the link member may be slidably coupled to the door.

The link member may include a plurality of rotating-direction guide bars extending toward the roller frame, and the roller frame may include a plurality of rotating-direction guide slots to accommodate the plurality of rotating-direction guide bars so as to guide rotation of the link member.

The link member may include a sliding rod extending toward the door, and the door may include a sliding rail to accommodate the sliding rod so as to guide sliding of the link member.

The link member may be moved along a rotating axis thereof when rotated relative to the roller frame by the predetermined angle.

The link member may include a rotating-axis movement guide boss extending toward the roller frame, and the roller frame may include a rotating-axis movement guide slope to come into contact with the rotating-axis movement guide boss so as to guide movement of the link member along the rotating axis thereof.

The link member may be elastically supported on the roller frame.

The link member may be moved along the rotating axis to fasten or unfasten the roller frame to or from the body frame.

The link member may include a coupling protrusion extending toward the body frame, the body frame may include a coupling protrusion recess corresponding to the coupling protrusion, and the coupling protrusion may be inserted into or separated from the coupling protrusion recess as the link member is moved along the rotating axis.

The transfer roller assembly may further include a transfer roller pressure member rotatably provided at the roller frame, and a coupler movable along a rotating axis of the transfer roller pressure member, and the coupler may be connected to a drive source to rotate the transfer roller pressure member.

The coupler may be moved along with the link member so as to control transmission of power of the drive source.

The coupler may be elastically supported on the transfer roller pressure member.

The transfer roller pressure member may include a shaft and cams provided at both sides of the shaft, and each of the cams may include a pressure portion interfering with the transfer roller.

The transfer roller assembly may further include a transfer roller separation member to allow the transfer roller to be elastically supported on the roller frame.

The foregoing and/or other features and utilities of the present general inventive concept may be achieved by providing an image forming apparatus including a body frame, a door to open or close one side of the body frame, an intermediate transfer belt provided in the body frame, to which a toner image is transferred, and a transfer roller assembly to transfer the toner image transferred to the intermediate transfer belt to a printing medium, wherein the transfer roller assembly has a rotating axis kept at a fixed position of the body frame, and is rotated about the rotating axis in linkage with an opening/closing operation of the door.

The transfer roller assembly may be fastened to or unfastened from the body frame in linkage with the opening/closing operation of the door.

The transfer roller assembly may perform transmission/interception of power of a drive source in linkage with the opening/closing operation of the door.

The foregoing and/or other features and utilities of the present general inventive concept may be achieved by providing an image forming apparatus including a body frame, a door to open or close the body frame, a roller frame rotatably provided at the body frame, and a link member to link the door and the roller frame to each other, wherein the link member restricts rotation of the roller frame when the door is closed, and allows the roller frame to be rotated when the door is opened.

The link member may be moved along a rotating axis of the roller frame when the door is opened or closed.

At least a part of the link member may be coupled to the body frame when the door is closed, and may be separated from the body frame when the door is opened.

The link member may be rotated relative to the roller frame by a predetermined range when the door is opened or closed by a predetermined angle.

The link member may be rotated along with the roller frame when the door is further opened beyond the predetermined angle.

The foregoing and/or other features and utilities of the present general inventive concept may be achieved by providing an image forming apparatus, including a body frame, a door to open or close the body frame, a transfer roller assembly to transfer an image to a printing medium, and a link member to couple the transfer roller assembly to the door such that the transfer roller assembly rotates about a first axis upon a movement of the door.

The image forming apparatus may further include sliding rail to slidingly couple the link member to the door such that the link member slides along the sliding rail during a movement of the door.

The link member may further include a sliding rod to restrict the sliding movement of the link member to a length of the sliding rod.

The link member may rotate about a second axis to fully open or close the door.

The body may further include a supporting portion to restrict a rotational movement of the transfer roller assembly.

BRIEF DESCRIPTION OF THE DRAWINGS

These and/or other features of the general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
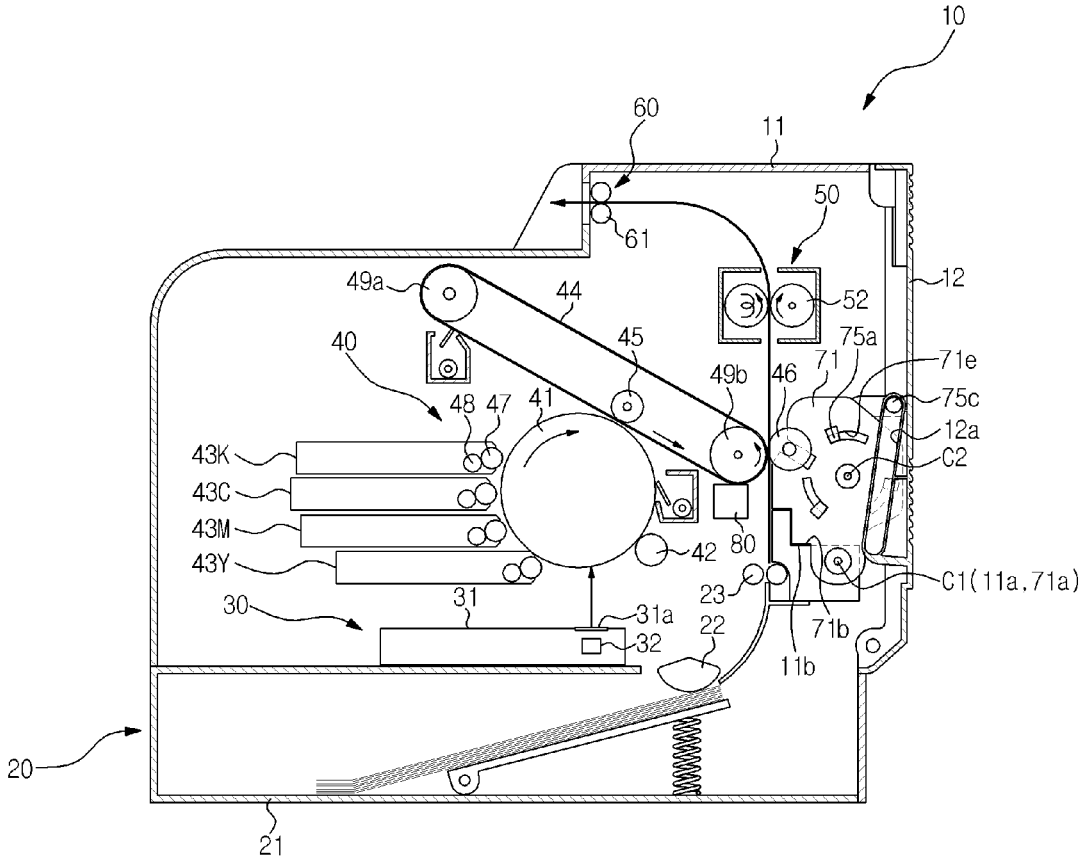
FIG. 1 is a side sectional view illustrating an interior configuration of an image forming apparatus according to an exemplary embodiment of the present general inventive concept.

Reference will now be made in detail to an image forming apparatus according to the embodiment of the present general inventive concept, examples of which are illustrated in the accompanying drawings, wherein like reference numerals refer to like elements throughout.

FIG. 1 is a side sectional view illustrating an interior configuration of an image forming apparatus according to an exemplary embodiment of the present general inventive concept.

As illustrated in FIG. 1, the image forming apparatus includes a main body 10, a paper feeding device 20 to feed printing media, i.e. paper, a light scanning device 30 to irradiate light corresponding to image information, a developing device 40 to develop an image on the paper, a fusing device 50 to fuse the image on the paper by applying heat and pressure to the paper, and a paper discharge device 60 to discharge the paper, on which the image has been completely printed, to an area outside of the main body 10.

The main body 10 includes a body frame 11 to accommodate or support a variety of constituent elements installed in the main body 10, and a door 12 which is movable relative to the body frame 11. For example, the door 12 is pivotally rotatably coupled to the body frame 11 to open or close a part of the main body 10. This allows a user to access the interior of the main body 10 through the door 12 for repair or replacement of elements or removal of jammed paper.

The paper feeding device 20 includes a paper feeding cassette 21 in which the paper is stored, a pickup roller 22 to pick up the paper stored in the paper feeding cassette 21 sheet by sheet, and a delivery roller 23 to move the picked-up paper toward the developing device 40. The paper feeding cassette 21 may be separably coupled to the body frame 11.

The light scanning device 30 includes a housing 31 having a transparent member 31*a* through which light is emitted, and a light source 32 mounted in the housing 31. If the light source 32 of the light scanning device 30 emits light, the light is discharged to the outside of the housing 31 through the transparent member 31*a* and is irradiated to a photoconductor 41 of the developing device 40, causing an electrostatic latent image corresponding to image information to be formed on a surface of the photoconductor 41.

The developing device 40 includes the photoconductor 41 on a surface of which the electrostatic latent image is formed by the light scanning device 30, a charging roller 42 to charge the photoconductor 41, four developing units 43Y, 43M, 43C and 43K to develop the electrostatic latent image formed on the photoconductor 41 into a toner image using yellow, magenta, cyan and black toners, respectively, an intermediate transfer belt 44, a first transfer roller 45 and a second transfer roller 46.

Each of the developing units 43Y, 43M, 43C and 43K includes a developing roller 47 to develop the electrostatic latent image formed on the photoconductor 41 using the toner, and a feed roller 48 to feed the toner to the developing roller 47 while being rotated in contact with the developing roller 47.

The intermediate transfer belt 44 is supported by support rollers 49*a* and 49*b* and travels at the same speed as a rotational linear speed of the photoconductor 41. The first transfer roller 45 is arranged to face the photoconductor 41 with the intermediate transfer belt 44 therebetween and serves to transfer the toner image developed on the photoconductor 41 to the intermediate transfer belt 44. The second transfer roller 46 is installed to selectively come into contact with the intermediate transfer belt 44. Specifically, the second transfer roller 46 is spaced apart from the intermediate transfer belt 44 while the toner image is transferred from the photoconductor 41 to the intermediate transfer belt 44, and comes into contact with the intermediate transfer belt 44 at a predetermined pressure after the toner image has been completely transferred to the intermediate transfer belt 44. When the second transfer roller 46 comes into contact with the intermediate transfer belt 44, the toner image on the intermediate transfer belt 44 is transferred to the paper.

The fusing device 50 includes a heating roller 51 having a heat source to apply heat to the paper onto which the toner image has been transferred, and a pressure roller 52 arranged to face the heating roller 51 while maintaining a constant fusing pressure with the heating roller 51. The paper discharge device 60 includes a paper discharge roller 61 to deliver the paper having passed through the fusing device 50 to the outside of the main body 10.

An operation of the image forming apparatus having the above described configuration will be described in brief. If the light scanning device 30 irradiates light corresponding to information about a yellow image to the photoconductor 41 which has been charged with a constant potential by the charging roller 42, an electrostatic latent image corresponding to the yellow image is formed on the photoconductor 41. Then, the developing roller 47 of the yellow developing unit 43Y acts to attach yellow toner to the electrostatic latent image upon receiving a developing bias applied thereto so as to develop the electrostatic latent image into a yellow toner image on the photoconductor 41. The toner image is transferred to the intermediate transfer belt 44 by the first transfer roller 45. After transfer of the yellow toner image for one page is completed, the light scanning device 30 irradiates light corresponding to information about a magenta image to the photoconductor 41 so as to form an electrostatic latent image corresponding to the magenta image. The magenta developing unit 43M develops the electrostatic latent image into a magenta toner image using magenta toner. The magenta toner image formed on the photoconductor 41 is transferred to the intermediate transfer belt 44 so as to overlap with the previously transferred yellow toner image. As the above-described operation is repeated with respect to cyan and black images, a color toner image obtained by overlapping the yellow, magenta, cyan and black toner images is formed on the intermediate transfer belt 44. The color toner image is transferred to paper passing between the intermediate transfer belt 44 and the second transfer roller 46, and the image transferred to the paper is fused to the paper upon receiving heat and pressure while passing through the fusing device 50. Finally, the paper having passed through the fusing device 50 is discharged to the outside by the paper discharge roller 61.

Figure 2:
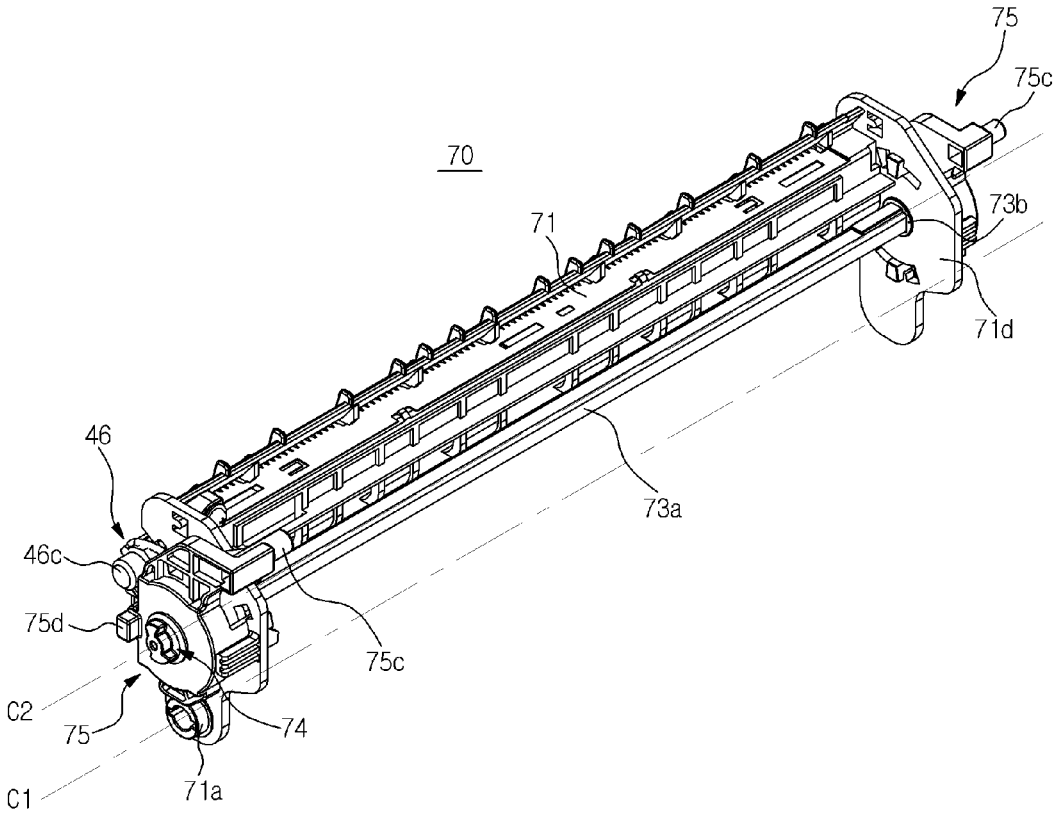
FIG. 2 is a perspective view illustrating a second transfer roller assembly according to an exemplary embodiment of the present general inventive concept.
Figure 3:
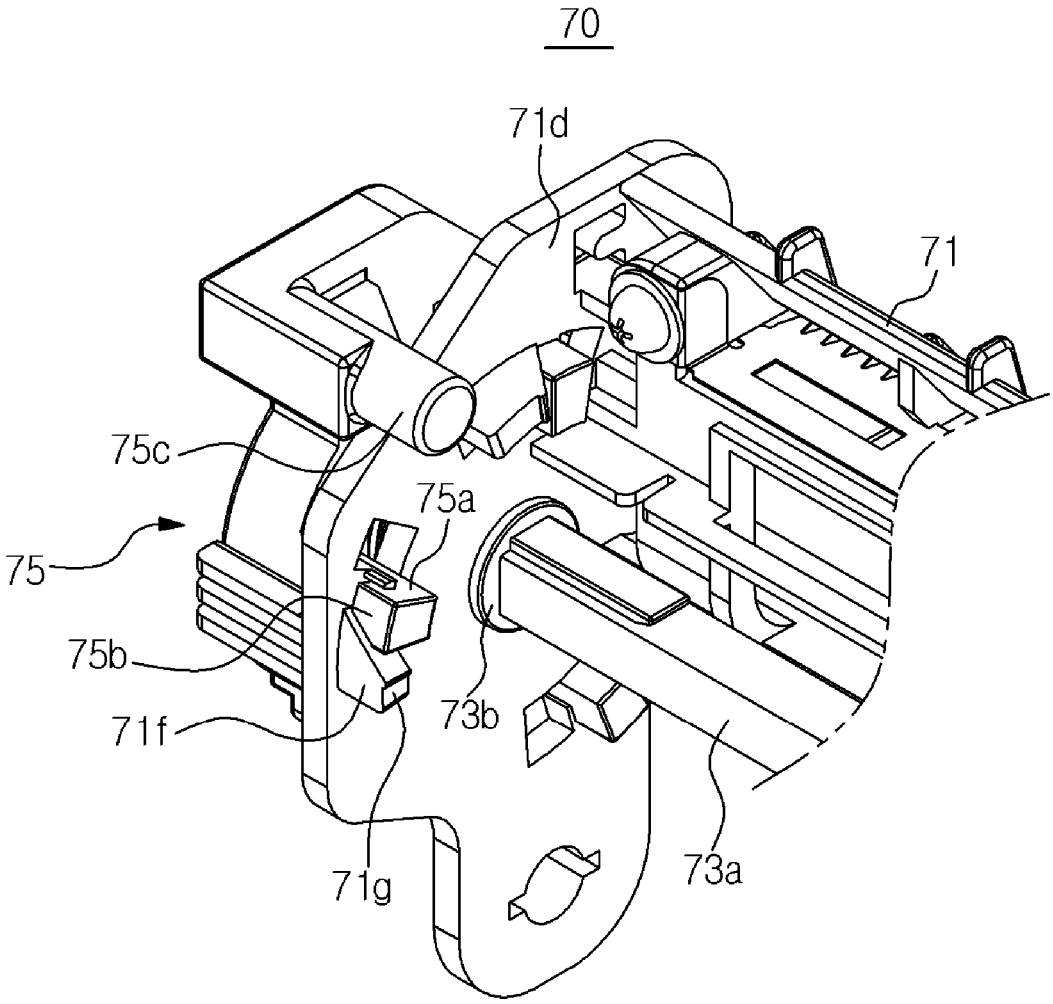
FIG. 3 is a partial view of the second transfer roller assembly when viewed at a different angle from FIG. 2.
Figure 4:
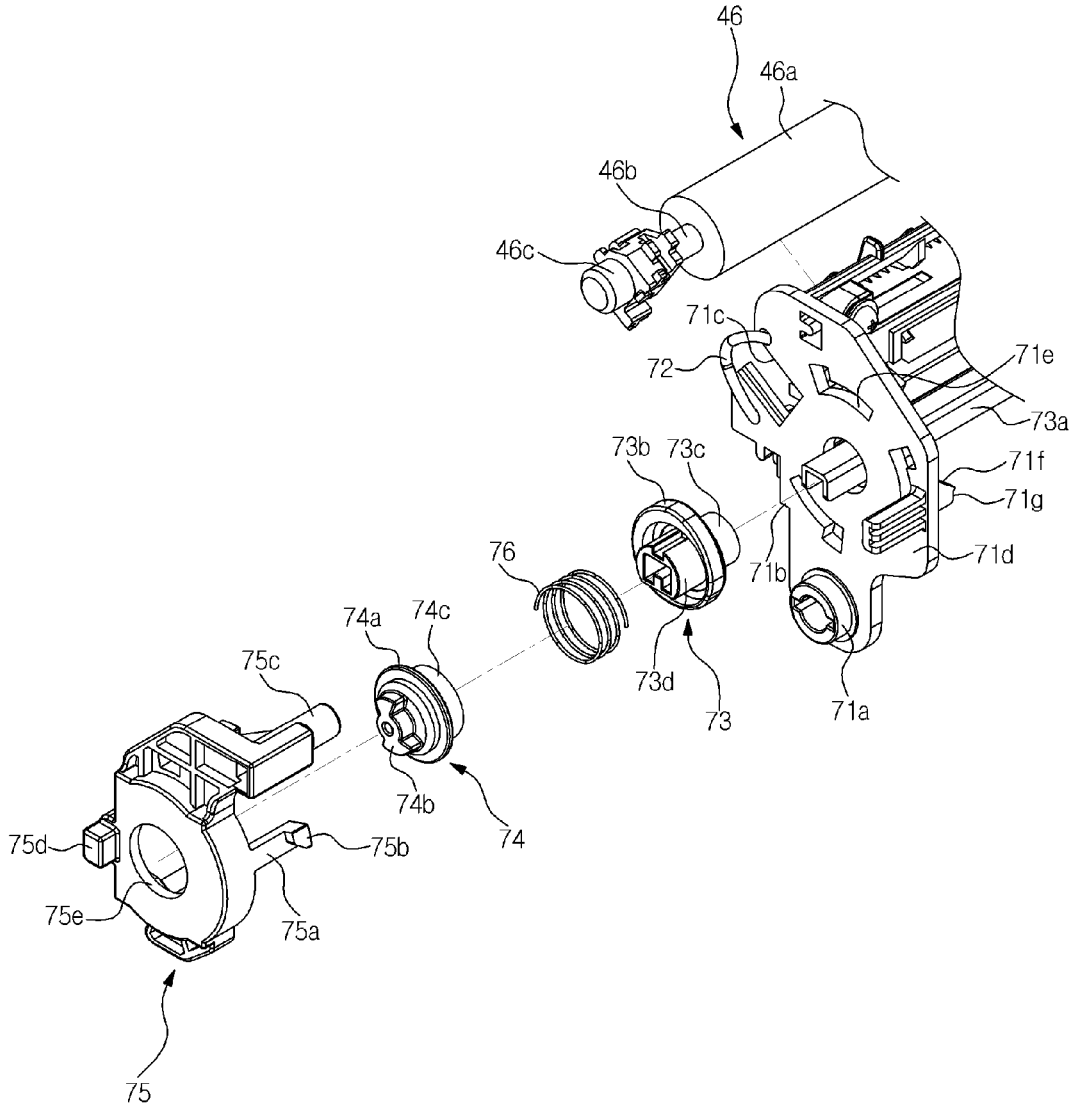
FIG. 4 is an exploded perspective view of the second transfer roller assembly according to an exemplary embodiment of the present general inventive concept.
Figure 5:
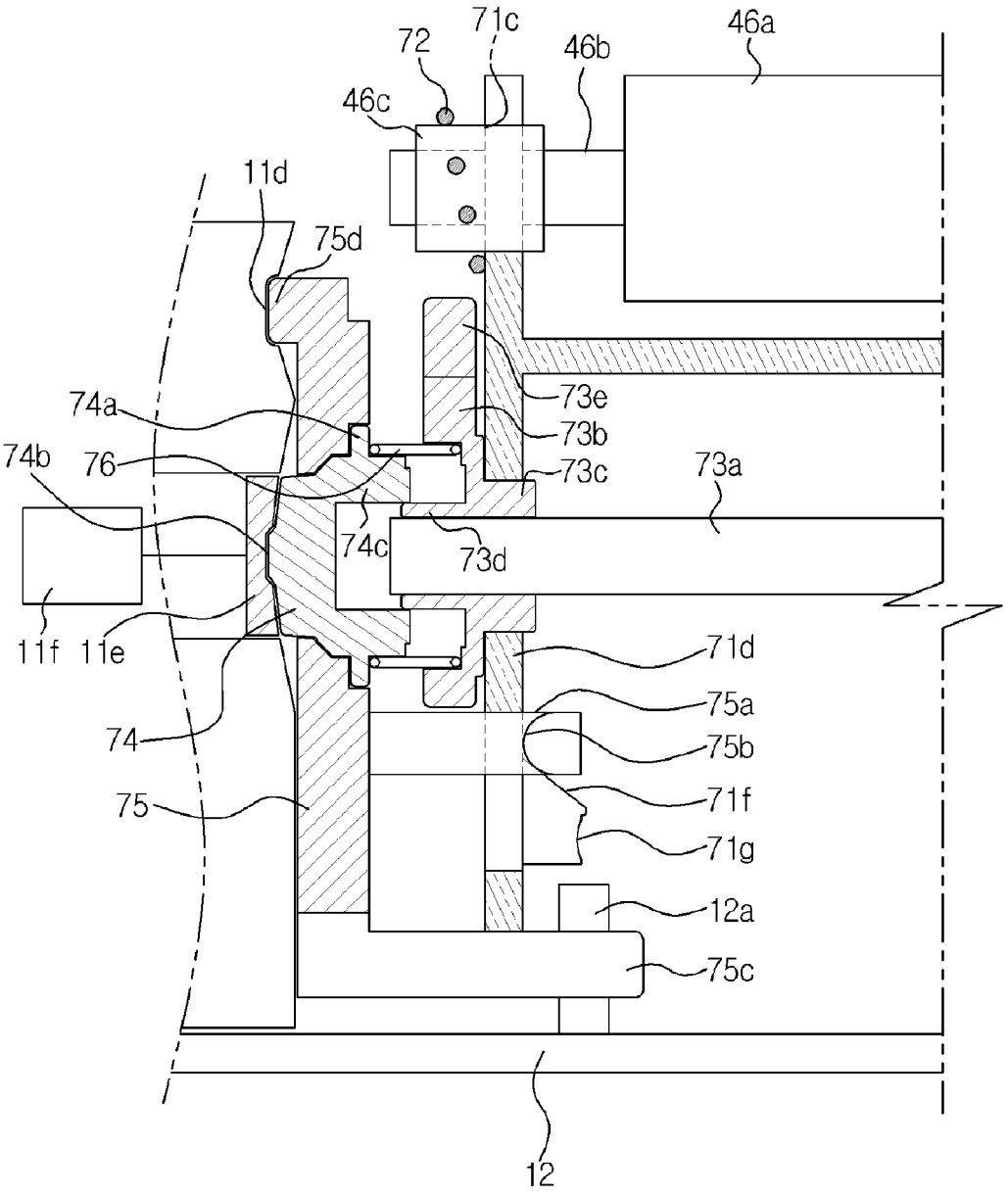
FIG. 5 is a plan sectional view illustrating a mounted state of the second transfer roller assembly when a door is closed, according to an exemplary embodiment of the present general inventive concept.

FIG. 2 is a perspective view illustrating the second transfer roller assembly 70 according to an exemplary embodiment of the present general inventive concept, FIG. 3 is a partial view of the second transfer roller assembly when viewed at a different angle from FIG. 2, FIG. 4 is an exploded perspective view of the second transfer roller assembly 70 according to an exemplary embodiment of the present general inventive concept, and FIG. 5 is a plan sectional view illustrating a mounted state of the second transfer roller assembly 70 when a door is closed, according to an exemplary embodiment of the present general inventive concept.

As illustrated in FIGS. 1 through 5, the second transfer roller assembly 70 may include a roller frame 71, the second transfer roller 46, a second transfer roller separation member 72, a second transfer roller pressure member 73, a coupler 74, and a link member 75.

The roller frame 71 may be rotatably coupled to the body frame 11. The roller frame 71 has a hinge 71*a* inserted into a hinge receptacle 11*a* of the body frame 11. Here, the hinge 71*a* and the hinge receptacle 11*a* define a first rotating axis C1 of the roller frame 71. The roller frame 71 is rotatable relative to the body frame 11 about the first rotating axis C1.

The roller frame 71 may be coupled to the body frame 11 so as to be seated on the body frame 11. Specifically, the roller frame 71 has a seating portion 71*b* seated on a support portion 11*b* of the body frame 11. Once the roller frame 71 has been seated on the body frame 11, the roller frame 71 is not rotated toward the support roller 49*b*. In this way, the roller frame 71 is mounted at a fixed position.

The second transfer roller 46 may be rotatably coupled to the roller frame 71. The second transfer roller 46 may include a roller 46*a* and shafts 46*b* provided at opposite ends of the roller 46*a*. Each shaft 46*b* is rotatably inserted into a separation/pressure body 46*c* and the separation/pressure body 46*c* is movably inserted into a separation/pressure guide groove 71*c* of the roller frame 71. Thus, the second transfer roller 46 is rotatable while being inserted in the separation/pressure body 46*c* and is movable along the separation/pressure guide groove 71*c* along with the separation/pressure body 46*c*. This allows the second transfer roller 46 to be spaced apart from the support roller 49*b* or to be rotated along with the support roller 49*b* while in contact therewith.

The second transfer roller separation member 72 may move the second transfer roller 46 away from the support roller 49*b*. The second transfer roller separation member 72 may be a spring, but is not limited thereto. Both ends of the second transfer roller separation member 72 are secured to the roller frame 71, and a center portion of the second transfer roller separation member 72 is configured to surround the separation/pressure body 46*c*. Thus, the second transfer roller separation member 72 may apply elastic force to the separation/pressure body 46*c* to move the separation/pressure body 46*c* in a direction in which the separation/pressure body 46*c* is moved away from the support roller 49*b*. In conclusion, the second transfer roller 46 may be elastically supported on the roller frame 71 by the second transfer roller separation member 72 so as to be moved away from the support roller 49*b*.

The second transfer roller pressure member 73 may move the second transfer roller 46 toward the support roller 49*b*. The second transfer roller pressure member 73 may include a shaft 73*a* and cams 73*b*. The cams 73*b* are rotatably provided at both sidewalls 71*d* of the roller frame 71, and the shaft 73*a* connects the cams 73*b* to each other. Here, the shaft 73*a* and the cams 73*b* define a second rotating axis C2. A first coupling portion 73*c* of each cam 73*b* penetrates the sidewall 71*d* of the roller frame 71 to accommodate an end of the shaft 73*a*. The cam 73*b* and the shaft 73*a* are coupled to each other to restrict rotation thereof. That is, if one cam 73*b* provided at one end of the shaft 73*a* is rotated, the other cam 73*b* provided at the other end of the shaft 73*a* is simultaneously rotated. For example, a coupling region of the cam 73*b* and the shaft 73*a* may have a "U"-shaped cross section.

A pressure portion 73*e* extends from the cam 73*b* toward the separation/pressure body 46*c* so as to come into contact with the separation/pressure body 46*c*. If the cam 73*b* is rotated, the pressure portion 73*e* of the cam 73*b* pushes the separation/pressure body 46*c* toward the support roller 49*b*. The second transfer roller 46 is moved along with the separation/pressure body 46*c*, thereby coming into close contact with the support roller 49*b*.

The coupler 74 may connect the second transfer roller pressure member 73 to a drive source 80. Here, the drive source 80 installed in the main body 10 may be a drive motor to drive several elements including the pickup roller 22 and the delivery roller 23 of the paper feeding device 20 and the developing device 40. The drive source 80 may include a series of gears, pulleys, knobs, switches, etc., but is not limited thereto.

The coupler 74 is coupled to each cam 73*b*. A second coupling portion 73*d* of the cam 73*b* extends toward the coupler 74 and is inserted into an insertion portion 74*c* of the coupler 74. The coupler 74 and the second coupling portion 73*d* are coupled to each other to restrict rotation thereof. Thus, the coupler 74 is rotatable about the second rotating axis C2 along with the cam 73*b* and also, is movable along the second rotating axis C2 independently of the cam 73*b*.

The coupler 74 may be elastically supported on the cam 73*b*. An elastic member 76 is interposed between the coupler 74 and the cam 73*b*. The elastic member 76 may apply pressure to the coupler 74 in a direction in which the coupler 74 is moved away from the cam 73*b*.

The link member 75 may be coupled to the sidewall 71*d* of the roller frame 71 so as to be pivotally rotated by a predetermined range (or angle). The link member 75 is provided with a plurality of arc-shaped rotating-direction guide bars 75*a* protruding toward the roller frame 71, and the sidewall 71*d* of the roller frame 71 is provided with a plurality of arc-shaped rotating-direction guide slots 71*e* corresponding to the respective rotating-direction guide bars 75*a*. As the plurality of rotating-direction guide bars 75*a* are respectively inserted into the plurality of rotating-direction guide slots 71*e*, the link member 75 is guided to be rotated relative to the sidewall 71*d* of the roller frame 71 by a predetermined angle about the second rotating axis C2.

Each rotating-direction guide bar 75*a* is provided at an end thereof with a rotating-axis-movement guide boss 75*b*, and the sidewall 71*d* of the roller frame 71 is provided at an inner surface thereof with a rotating-axis-movement guide slope 71*f*. The guide slope 71*f* is provided at an upper end thereof with a rotating-direction guide seat 71*g*. As the rotating-axis-movement guide boss 75*b* slides upward along the rotating-axis-movement guide slope 71*f*, the link member 75 is rotated about the second rotating axis C2 and is moved toward the sidewall 71*d* of the roller frame 71 along the second rotating axis C2. Thereafter, once the rotating-axis-movement guide boss 75*b* has been seated on the rotating-direction guide seat 71*g*, the link member 75 is rotatable about the first rotating axis C1 along with the roller frame 71.

The link member 75 has a sliding rod 75*c* slidably coupled to the door 12. The sliding rod 75*c* extends from the link member 75 toward the door 12, and the door 12 is provided with a sliding rail 12*a* to guide the sliding rod 75*c*. As the door 12 is opened or closed, the sliding rod 75*c* of the link member 75 is movable along the sliding rail 12*a*. With this configuration, the link member 75 is operated in linkage with an opening and/or closing of the door 12.

The link member 75 may be coupled to the body frame 11 to fasten the roller frame 71 to the body frame 11, or to unfasten the roller frame 71 from the body frame 11. The link member 75 has a coupling protrusion 75*d* extending toward the body frame 11, and the body frame 11 is provided with a coupling protrusion recess 11*d* to allow the coupling protrusion 75*d* to be inserted thereinto. When the link member 75 is moved along the second rotating axis C2 and the coupling protrusion 75*d* is inserted into the coupling protrusion recess 11*d*, the roller frame 71 is fastened to the body frame 11. Also, when the coupling protrusion 75*d* is separated from the coupling protrusion recess 11*c*, the roller frame 71 is unfastened from the body frame 11.

The coupler 74 may be coupled to a center portion of the link member 75. An upper partial portion of the coupler 74 protrudes from a center through-hole 75*e* of the link member 75. The through-hole 75*e* of the link member 75 is supported by an outer rim wall 74*a* of the coupler 74. Thus, the link member 75 is rotatable about the second rotating axis C2 independently of the coupler 74. Also, the link member 75 is movable along the second rotating axis C2 along with the coupler 74. That is, when the link member 75 is moved toward the roller frame 71, the link member 75 applies pressure to the outer rim wall 74*a* of the coupler 74 inserted in the through-hole 75*e* thereof, causing the coupler 74 to be moved toward the roller frame 71. When the coupler 74 is moved away from the roller frame 71 by the elastic member 76, the outer rim wall 74*a* of the coupler 74 applies pressure to the through-hole 75*e* of the link member 75, causing the link member 75 to be moved away from the roller frame 71.

Figure 6:
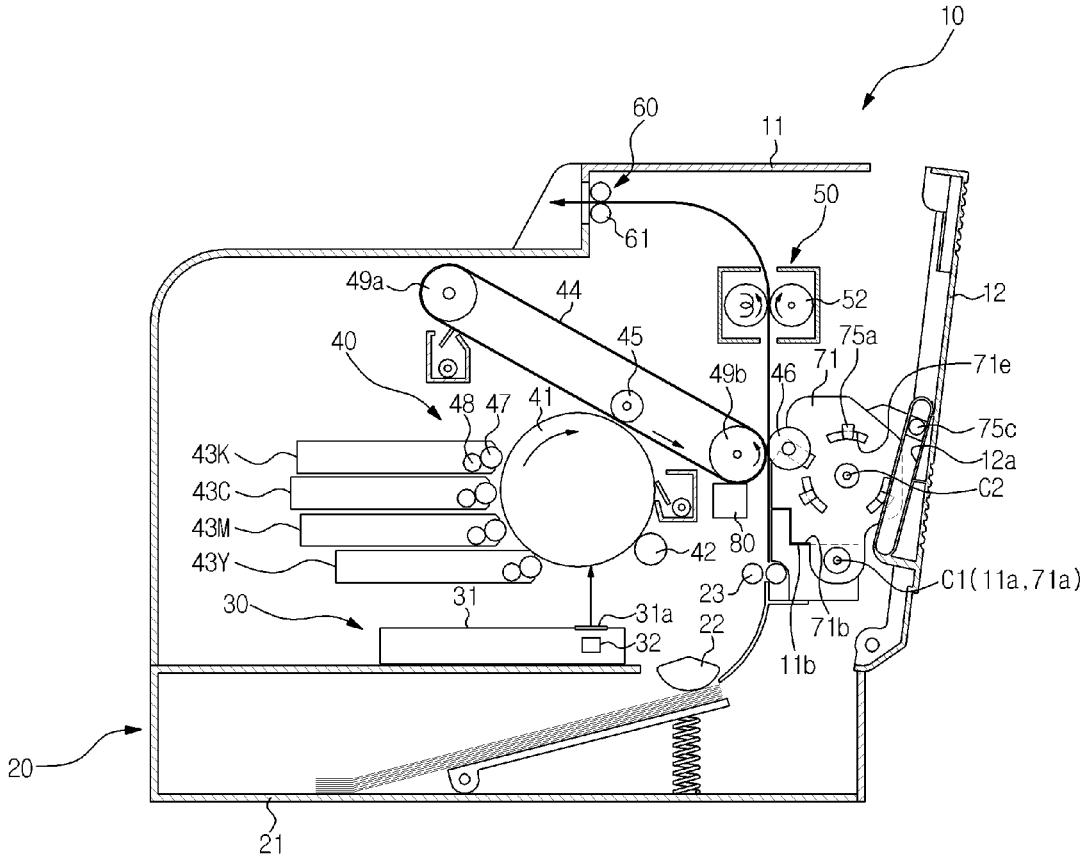
FIG. 6 is a side sectional view illustrating a mounted state of the second transfer roller assembly when the door begins to be opened, according to an exemplary embodiment of the present general inventive concept.
Figure 7:
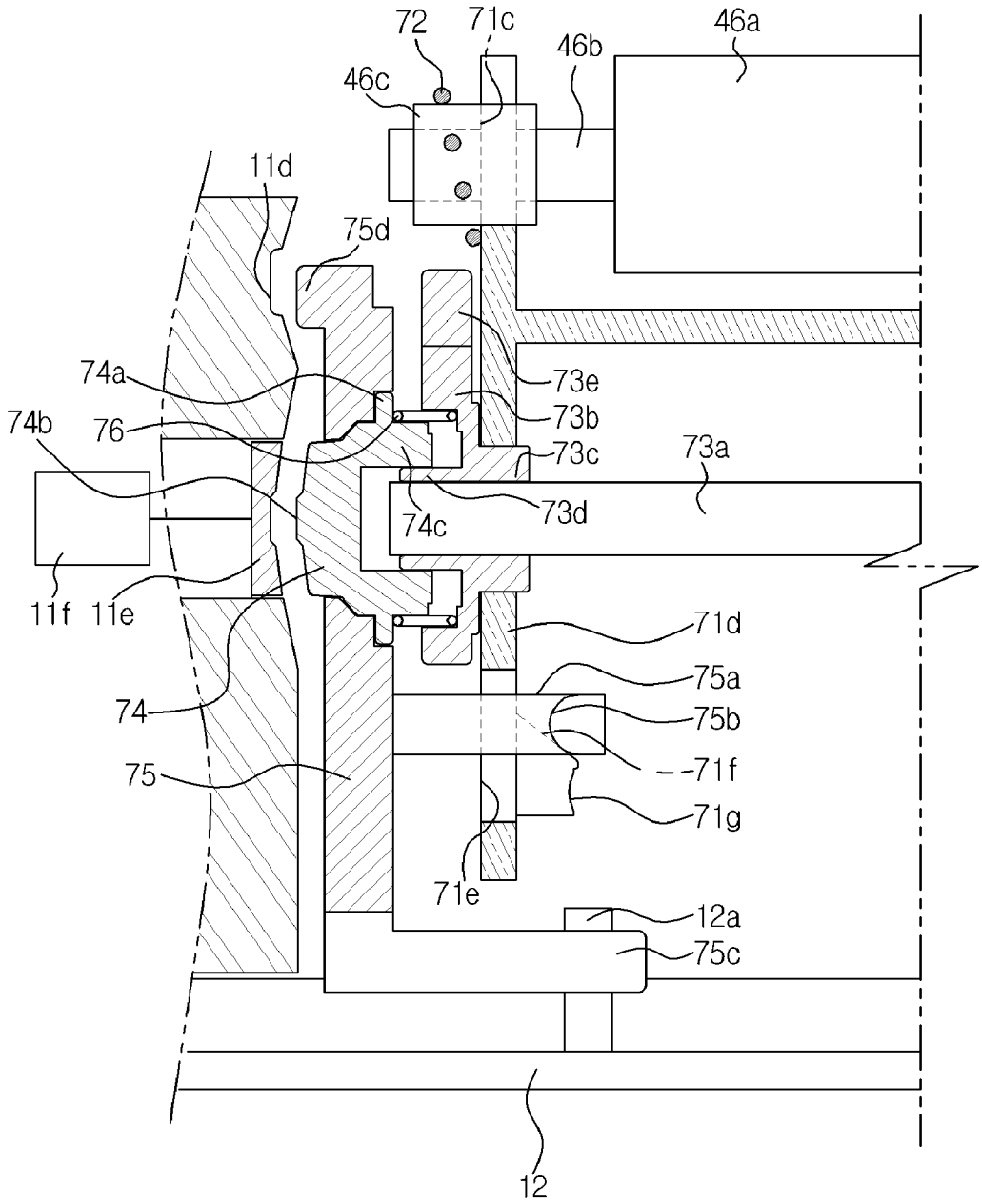
FIG. 7 is a plan sectional view of the second transfer roller assembly of FIG. 6.

FIG. 6 is a side sectional view illustrating a mounted state of the second transfer roller assembly 70 when the door 12 begins to be opened, according to an exemplary embodiment of the present general inventive concept, and FIG. 7 is a plan sectional view of the second transfer roller assembly 70 of FIG. 6.

As illustrated in FIGS. 1 through 7, first, an operation to open the door 12 away from the body frame 11 will be described. If the door 12 begins to be opened, the sliding rail 12*a* pulls the sliding rod 75*c* of the link member 75. In this case, the rotating-direction guide bar 75*a* of the link member 75 begins to slide in the rotating-direction guide slot 71*e* of the roller frame 71 and the link member 75 is rotated about the second rotating axis C2. In addition, the rotating-axis-movement guide boss 75*b* of the link member 75 begins to slide upward on the rotating-axis-movement guide slope 71*f* of the roller frame 71 and the link member 75 is moved along the second rotating direction C2 toward the roller frame 71. In this case, the coupling protrusion 75*d* of the link member 75 is separated from the coupling protrusion recess 11*c* of the body frame 11. Also, as the link member 75 applies pressure to the coupler 74 so as to contract the elastic member 76, the coupler 74 is separated from a clutch 11*e*. Thereby, the roller frame 71 is unfastened from the body frame 11 and is rotatable about the first rotating axis C1. The coupler 74 intercepts supply of power to the second transfer roller pressure member 73. In this case, the second transfer roller 46 is arranged adjacent to the support roller 49*b*. Also, the second transfer roller 46 is spaced apart from the support roller 49*b* by being elastically supported by the second transfer roller separation member 72.

Figure 8:
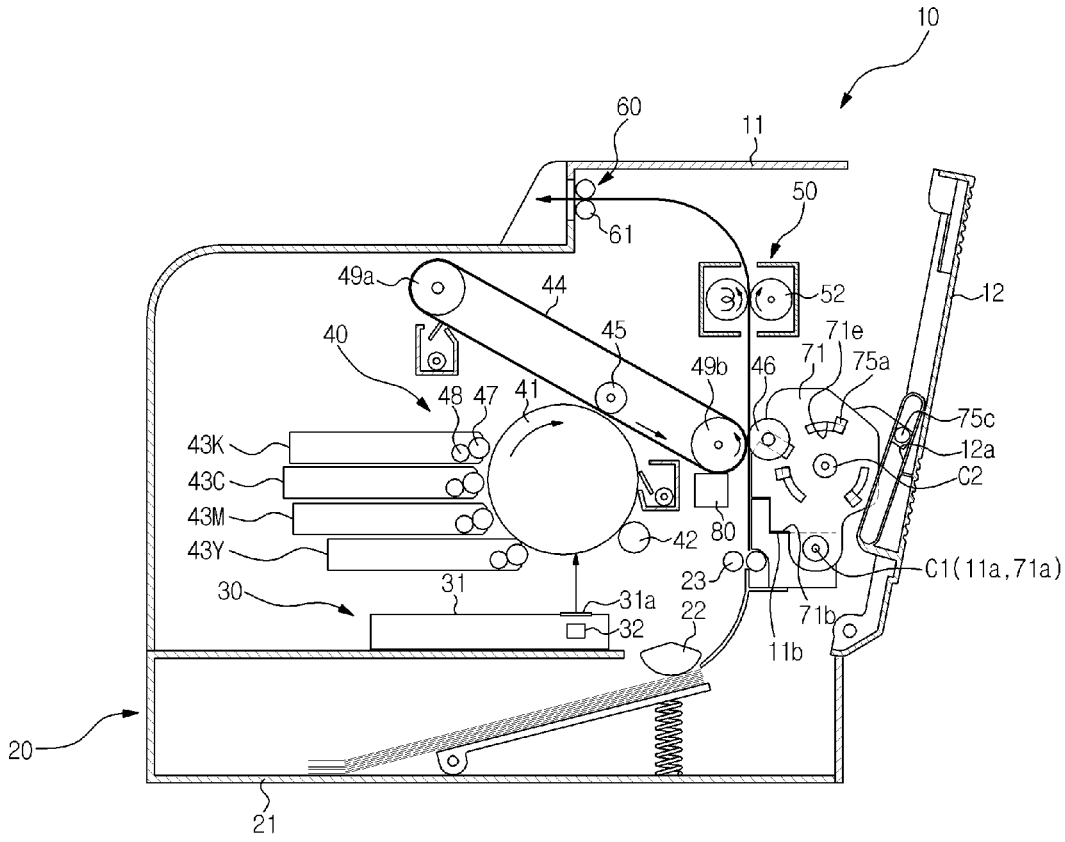
FIG. 8 is a side sectional view illustrating a mounted state of the second transfer roller assembly when the door is opened according to a predetermined angle, according to an exemplary embodiment of the present general inventive concept.
Figure 9:
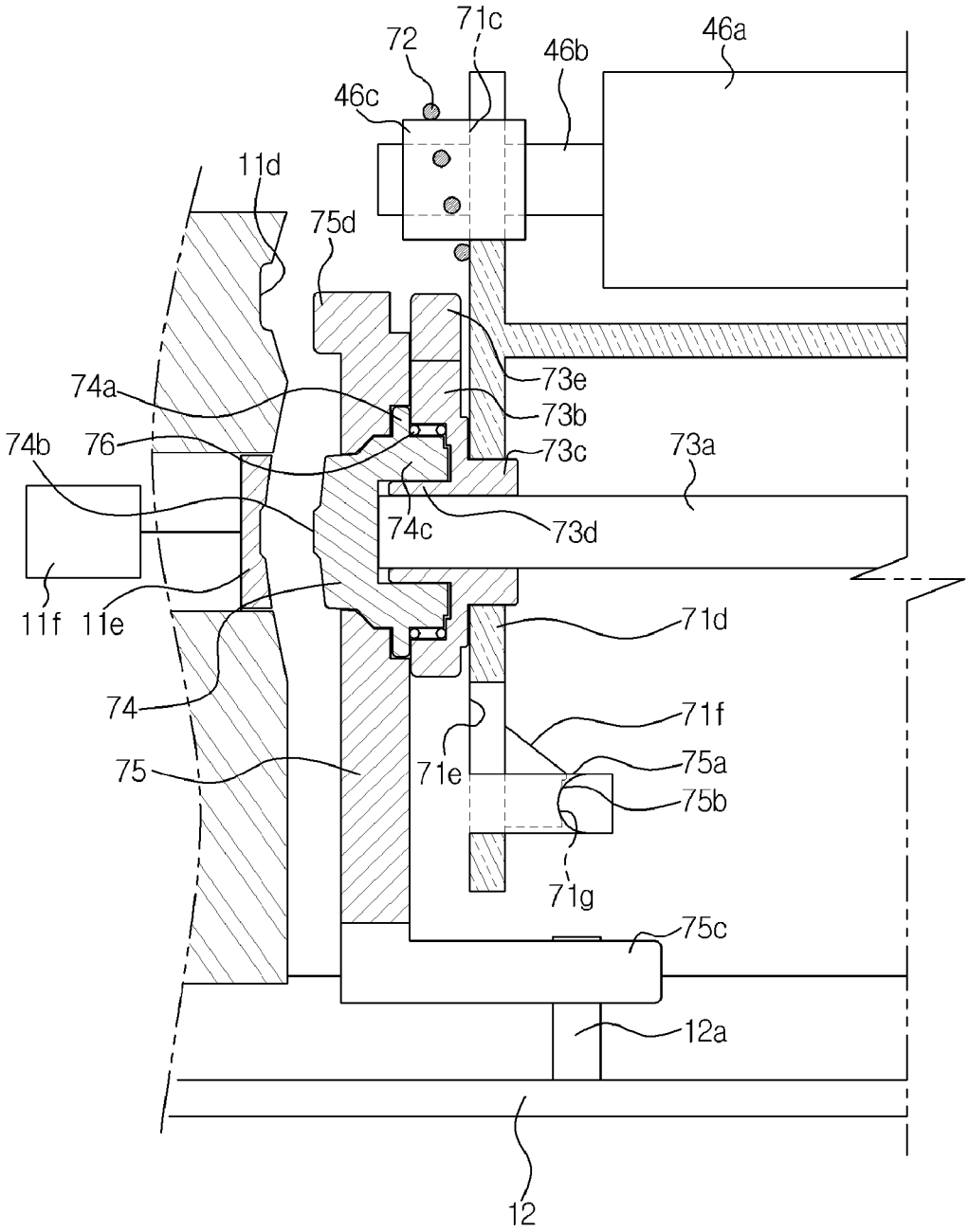
FIG. 9 is a plan sectional view of the second transfer roller assembly of FIG. 8.

FIG. 8 is a side sectional view illustrating a mounted state of the second transfer roller assembly 70 when the door 12 is opened by a predetermined angle, according to an exemplary embodiment of the present general inventive concept, and FIG. 9 is a plan sectional view of the second transfer roller assembly 70 of FIG. 8.

As illustrated in FIGS. 1 through 9, if the door 12 is opened by a predetermined angle (or range) as illustrated in FIG. 8, the link member 75 is rotated about the second rotating axis C2 and the sliding rod 75*c* of the link member 75 further slides on the sliding rail 12*a*. In this case, the rotating-direction guide bar 75*a* of the link member 75 completely slides to a first end of the rotating-direction guide slot 71*e* of the roller frame 71, and the link member 75 is completely rotated about the second rotating axis C2. Also, the rotating-axis-movement guide boss 75*b* of the link member 75 slides on the rotating-axis-movement guide slope 71*f* and is seated on the rotating-direction guide seat 71*g*. In this case, the rotating-axis-movement guide boss 75*b* and the rotating-direction guide seat 71*g* are fastened to each other so as not to be separated from each other as long as the user does not apply sufficient force to unfasten them. The link member 75 is moved along the second rotating axis C2 to a position closest to the sidewall 71*d* of the roller frame 71. In this case, the elastic member 76 is maximally compressed. Thereby, the roller frame 71 is unfastened from the body frame 11 and is rotatable about the first rotating axis C1. Of course, the second transfer roller 46 is arranged adjacent to the support roller 49*b*.

Figure 10:
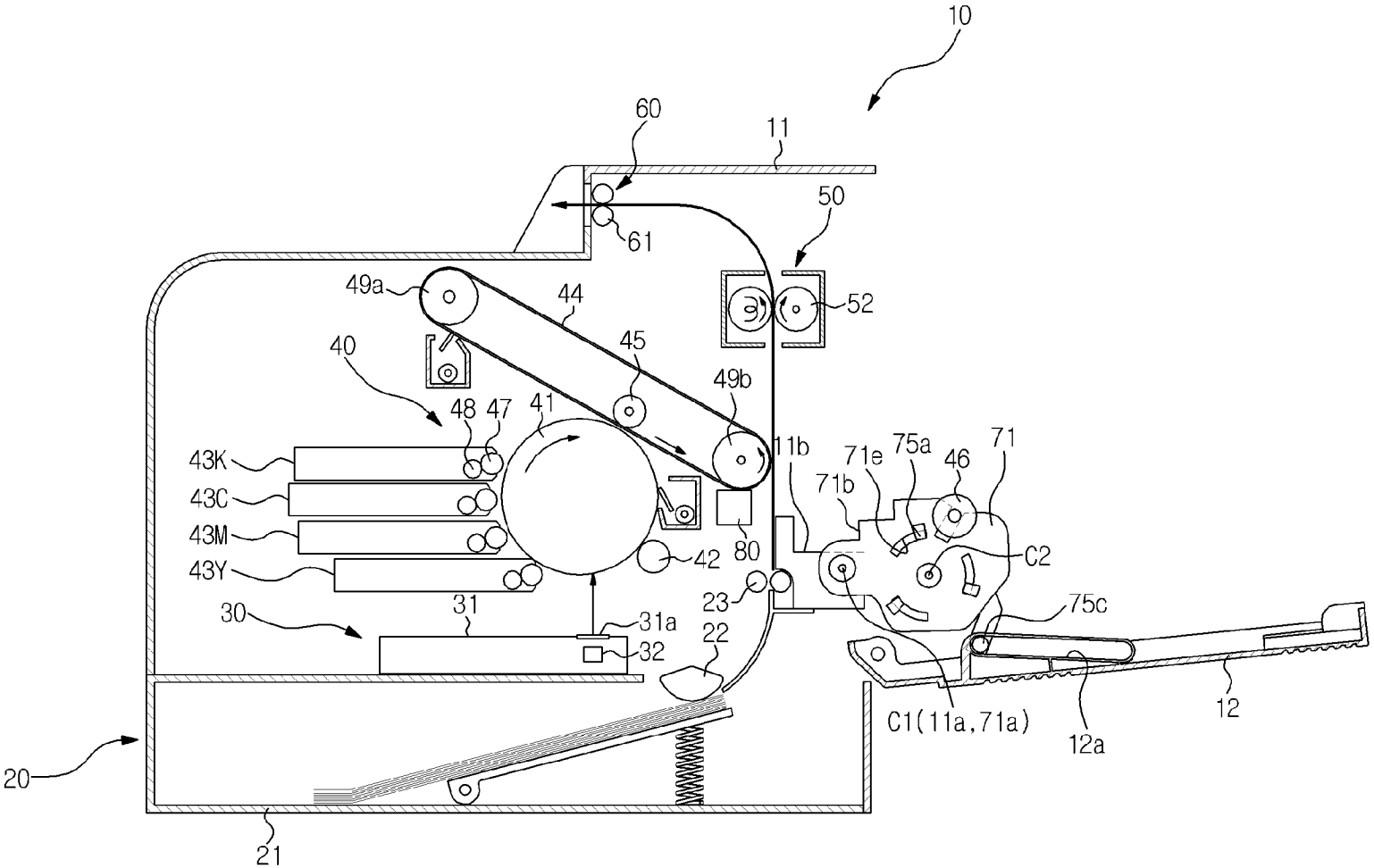
FIG. 10 is a side sectional view illustrating a mounted state of the second transfer roller assembly according to an exemplary embodiment of the present general inventive concept.

FIG. 10 is a side sectional view illustrating a mounted state of the second transfer roller assembly 70 when the door 12 is completely opened, according to an exemplary embodiment of the present general inventive concept.

As illustrated in FIGS. 1 through 10, if the door 12 is further rotated from the position as illustrated in FIG. 8 to the state as illustrated in FIG. 10, the link member 75 is rotated about the first rotating axis C1 along with the roller frame 71 and the sliding rod 75*c* of the link member 75 completely slides to a lower end of the sliding rail 12*a* of the door 12. Here, the rotating-direction guide bar 75*a* of the link member 75 is kept at a first end of the rotating-direction guide slot 71*e* of the roller frame 71. The second transfer roller 46 is completely separated from the support roller 49*b*. Thus, the user may easily remove jammed paper in an open state of the door 12 without additional operation.

Next, an operation to close the door 12 to the body frame 11 will be described. If the door 12 begins to be closed, the sliding rail 12*a* pushes the sliding rod 75*c* of the link member 75. As a result, the link member 75 and the roller frame 71 begin to rotate counterclockwise about the first rotating axis C1 because the rotating-axis movement guide boss 75*b* of the link member 75 is fastened to the rotating-direction guide seat 71*g* of the roller frame 71. Thereafter, if the door 12 is continuously rotated to reach the position as illustrated in FIG. 8, the seating portion 71*b* of the roller frame 71 is caught by the supporting portion 11*b* of the body frame 11, preventing the roller frame 71 from being further rotated counterclockwise about the first rotating axis C1. Here, if the user applies predetermined force to close the door 12, the door 12 reaches a position as illustrated in FIG. 6, and the rotating-axis movement guide boss 75*b* is separated from the rotating-direction guide seat 71*g* as illustrated in FIG. 7 and begins to slide downward on the rotating-axis movement guide slope 71*f*. Accordingly, the link member 75 is rotated counterclockwise about the second rotating axis C2 and is moved away from the sidewall 71*d* of the roller frame 71 along the second rotating axis C2. In addition, the coupler 74 is moved away from the roller frame 71 by elastic force of the elastic member 76.

Thereafter, if the user completely closes the door 12 as illustrated in FIG. 1, the link member 75 is rotated counterclockwise about the second rotating axis C2 and is further moved away from the sidewall 71*d* of the roller frame 71 along the second rotating axis C2 until the coupling protrusion 75*d* of the link member 75 is inserted into the coupling protrusion recess 11*c* of the body frame 11. In addition, the coupler 74 is further moved away from the roller frame 71 by elastic force of the elastic member 76, and includes a coupling member 74*b* that is coupled with the clutch 11*e*, which may be connected to a driving member 11*f* connected to the drive source 80. In this case, the roller frame 71 is completely fastened to the body frame 11.

Figure 11:
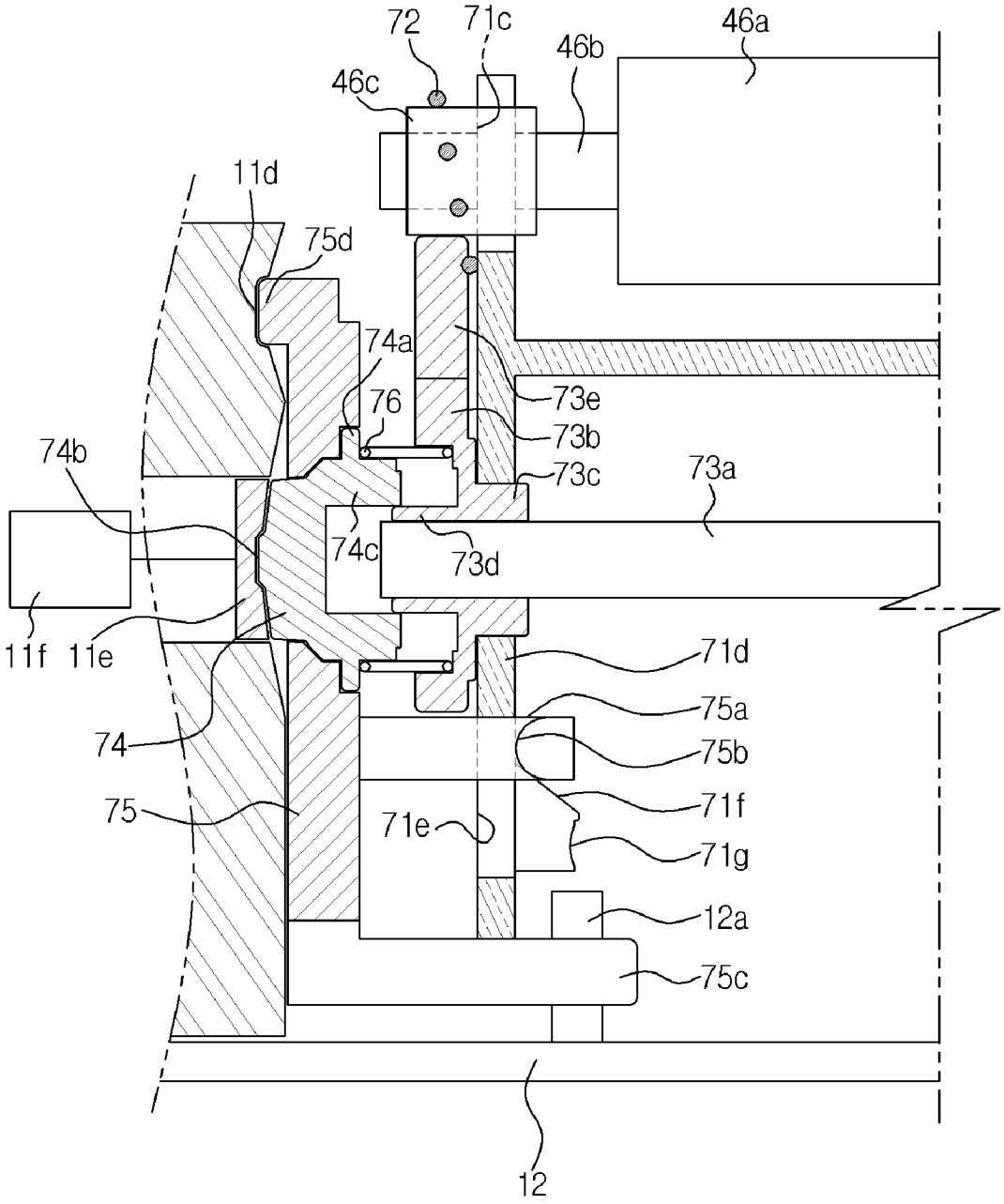
FIG. 11 is a plan sectional view illustrating operation of a second transfer roller pressure member according to an exemplary embodiment of the present general inventive concept.

FIG. 11 is a plan sectional view illustrating operation of the second transfer roller pressure member 73.

As illustrated in FIGS. 1 through 11, the coupler 74 may transmit power of the drive source 80 to the second transfer roller pressure member 73 in a completely closed position of the door 12. That is, as the coupler 74 is rotated to rotate the cam 73*b*, the pressure portion 73*e* of the cam 73*b* applies pressure to the separation/pressure body 46*c*, causing the second transfer roller 46 to be moved toward the support roller 49*b*. In this position, the second transfer roller 46 may transfer the toner image onto the paper.

As described above, with provision of the link member 75, as the door 12 is opened or closed, the roller frame 71 is rotated and is moved to be fastened to or unfastened from the body frame 11 and also, the coupler 74 is connected to or disconnected from the drive source 80. Thus, the second transfer roller assembly 70 having a simplified configuration ensures efficient utilization of the interior space of the body frame 11 and as a result, forms a compact image forming apparatus.

Further, since the roller frame 71 is supported by the body frame 11 about the first rotating axis C1, the roller frame 71 is kept at a fixed position when the door 12 is opened or closed, which may maximally reduce an assembly deviation of the second transfer roller 46. This may be advantageous to achieve uniform transfer performance.

As is apparent from the above description, the embodiment provides a transfer roller assembly having a minimized assembly deviation, which ensures uniform transfer performance.

Further, jammed printing paper may be conveniently removed by simply opening a door.

Furthermore, the door, the transfer roller assembly and a body frame have a simplified linkage configuration, which enhances utilization of the interior space of a main body and forms a compact image forming apparatus.

Although the embodiment of the present general inventive concept has been shown and described, it would be appreciated by those skilled in the art that changes may be made in these embodiments without departing from the principles and spirit of the invention, the scope of which is defined in the claims and their equivalents.

What is claimed is:

1. An image forming apparatus to form an image on a printing medium, comprising:

a body frame;

a support roller placed at one side of a movement path of the printing medium;

a transfer roller assembly placed at another side of the movement path of the printing medium at a position adjacent to the support roller; and a door to open or close the body frame so as to expose the movement path of the printing medium, wherein the transfer roller assembly has a rotating axis kept at a fixed position of the body frame, and is moved away from the support roller in linkage with an opening operation of the door.

2. The image forming apparatus according to claim 1, wherein the transfer roller assembly is returned toward the support roller in linkage with a closing operation of the door.

3. The image forming apparatus according to claim 2, wherein:

the transfer roller assembly includes a roller frame and a transfer roller rotatably supported on the roller frame; and the roller frame is hinged to the body frame.

4. The image forming apparatus according to claim 3, wherein the transfer roller assembly further includes hinges provided at both sides of the roller frame and hinge receptacles formed in the body frame for insertion of the hinges.

5. The image forming apparatus according to claim 3, wherein the transfer roller assembly further includes a link member, one side of which is coupled to the roller frame and the other side of which is coupled to the door.

6. The image forming apparatus according to claim 5, wherein one side of the link member is coupled to the roller frame so as to be rotated by a predetermined angle and the other side of the link member is slidably coupled to the door.

7. The image forming apparatus according to claim 6, wherein:

the link member includes a plurality of rotating-direction guide bars extending toward the roller frame; and the roller frame includes a plurality of rotating-direction guide slots to accommodate the plurality of rotating-direction guide bars so as to guide rotation of the link member.

8. The image forming apparatus according to claim 6, wherein:

the link member includes a sliding rod extending toward the door; and the door includes a sliding rail to accommodate the sliding rod so as to guide sliding of the link member.

9. The image forming apparatus according to claim 6, wherein the link member is moved along a rotating axis thereof when rotated relative to the roller frame by the predetermined angle.

10. The image forming apparatus according to claim 9, wherein:

the link member includes a rotating-axis movement guide boss extending toward the roller frame; and the roller frame includes a rotating-axis movement guide slope to come into contact with the rotating-axis movement guide boss so as to guide movement of the link member along the rotating axis thereof.

11. The image forming apparatus according to claim 10, wherein the link member is elastically supported on the roller frame.

12. The image forming apparatus according to claim 10, wherein the link member is moved along the rotating axis to fasten or unfasten the roller frame to or from the body frame.

13. The image forming apparatus according to claim 12, wherein:

the link member includes a coupling protrusion extending toward the body frame;

the body frame includes a coupling protrusion recess corresponding to the coupling protrusion; and the coupling protrusion is inserted into or separated from the coupling protrusion recess as the link member is moved along the rotating axis.

14. The image forming apparatus according to claim 5, wherein:

the transfer roller assembly further includes:

a transfer roller pressure member rotatably provided at the roller frame; and a coupler movable along a rotating axis of the transfer roller pressure member; and the coupler is connected to a drive source to rotate the transfer roller pressure member.

15. The image forming apparatus according to claim 14, wherein the coupler is moved along with the link member so as to control transmission of power of the drive source.

16. The image forming apparatus according to claim 14, wherein the coupler is elastically supported on the transfer roller pressure member.

17. The image forming apparatus according to claim 14, wherein the transfer roller pressure member includes a shaft and cams provided at both sides of the shaft, and each of the cams includes a pressure portion interfering with the transfer roller.

18. The image forming apparatus according to claim 5, wherein the transfer roller assembly further includes a transfer roller separation member to allow the transfer roller to be elastically supported on the roller frame.

19. An image forming apparatus, comprising:

a body frame;

a door to open or close one side of the body frame;

an intermediate transfer belt provided in the body frame, to which a toner image is transferred; and a transfer roller assembly to transfer the toner image transferred to the intermediate transfer belt to a printing medium, wherein the transfer roller assembly has a rotating axis kept at a fixed position of the body frame, and is rotated about the rotating axis in linkage with an opening/closing operation of the door.

20. The image forming apparatus according to claim 19, wherein the transfer roller assembly is fastened to or unfastened from the body frame in linkage with the opening/closing operation of the door.

21. The image forming apparatus according to claim 19, wherein the transfer roller assembly performs transmission/interception of power of a drive source in linkage with the opening/closing operation of the door.

22. An image forming apparatus, comprising:

a body frame;

a door to open or close the body frame;

a roller frame rotatably provided at the body frame; and a link member to link the door and the roller frame to each other, wherein the link member restricts rotation of the roller frame when the door is closed, and allows the roller frame to be rotated when the door is opened.

23. The image forming apparatus according to claim 22, wherein the link member is moved along a rotating axis of the roller frame when the door is opened or closed.

24. The image forming apparatus according to claim 22, wherein at least a part of the link member is coupled to the body frame when the door is closed, and is separated from the body frame when the door is opened.

25. The image forming apparatus according to claim 22, wherein the link member is rotated relative to the roller frame by a predetermined range when the door is opened or closed by a predetermined angle.

26. The image forming apparatus according to claim 24, wherein the link member is rotated along with the roller frame when the door is further opened beyond the predetermined angle.

27. An image forming apparatus, comprising:

a body frame;

a door to open or close the body frame;

a transfer roller assembly to transfer an image to a printing medium; and a link member to couple the transfer roller assembly to the door such that the transfer roller assembly rotates about a first axis upon a movement of the door.

28. The image forming apparatus of claim 27, further comprising:

a sliding rail to slidingly couple the link member to the door such that the link member slides along the sliding rail during a movement of the door.

29. The image forming apparatus of claim 28, wherein the link member further comprises a sliding rod to restrict the sliding movement of the link member to a length of the sliding rod.

30. The image forming apparatus of claim 27, wherein the link member rotates about a second axis to fully open or close the door.

31. The image forming apparatus of claim 30, wherein the body further comprises:

a supporting portion to restrict a rotational movement of the transfer roller assembly.

* * * * *